US007828882B2

(12) United States Patent
Dietz

(10) Patent No.: US 7,828,882 B2
(45) Date of Patent: Nov. 9, 2010

(54) AIR PURIFIER AND LIGHT

(76) Inventor: Dan L. Dietz, 10234 Emerald Dr., Houston, TX (US) 77074

( * ) Notice: Subject to any disclaimer, the term of this patent is extended or adjusted under 35 U.S.C. 154(b) by 0 days.

(21) Appl. No.: 12/138,888

(22) Filed: Jun. 13, 2008

(65) Prior Publication Data

US 2008/0307972 A1 Dec. 18, 2008

Related U.S. Application Data

(60) Provisional application No. 60/944,368, filed on Jun. 15, 2007.

(51) Int. Cl.
*B03C 3/32* (2006.01)

(52) U.S. Cl. ..... 96/15; 96/26; 96/83; 96/94

(58) Field of Classification Search ..... 96/15, 96/16, 26, 83, 97, 222, 224, 94; 422/24, 422/121; 261/DIG. 88, DIG. 89
See application file for complete search history.

(56) References Cited

U.S. PATENT DOCUMENTS 3,518,046 A * 6/1970 Cicirello ..... 96/224
4,102,654 A * 7/1978 Pellin ..... 96/16
4,210,429 A * 7/1980 Golstein ..... 96/142
5,330,722 A * 7/1994 Pick et al. ..... 96/55
5,601,636 A * 2/1997 Glucksman ..... 96/63
5,702,507 A * 12/1997 Wang ..... 96/55
5,964,189 A 10/1999 Northrop et al.
6,250,529 B1 6/2001 Babbitt et al.
6,413,302 B1 * 7/2002 Harrison et al. ..... 96/63
6,588,366 B1 7/2003 Ranson et al.
6,666,912 B1 * 12/2003 Yan ..... 96/224
6,841,136 B2 * 1/2005 Kwak ..... 422/186.03
7,056,372 B2 * 6/2006 Cheng ..... 96/224
7,175,814 B2 * 2/2007 Dionisio ..... 422/121
2003/0010211 A1 * 1/2003 Yu ..... 96/16
2004/0163542 A1 * 8/2004 Huang ..... 96/222
2004/0184975 A1 * 9/2004 Anno ..... 422/186.04
2006/0018805 A1 * 1/2006 Yuen ..... 422/121
2006/0078476 A1 * 4/2006 Yuen ..... 422/123
2006/0150819 A1 * 7/2006 Yuen ..... 96/224
2007/0207066 A1 * 9/2007 Thur et al. ..... 422/121

FOREIGN PATENT DOCUMENTS

FR 2408301 6/1979
JP 63-185424 A * 8/1988 ..... 96/222

* cited by examiner

*Primary Examiner*—Richard L Chiesa
(74) *Attorney, Agent, or Firm*—Daniel N. Lundeen; Lundeen & Lundeen, PLLC

(57) ABSTRACT

An illuminating air purifier is disclosed. In an embodiment, the illuminating air purifier includes an air ionizer, a back plate, and a light.

10 Claims, 2 Drawing Sheets

AIR PURIFIER AND LIGHT

This application claims priority to U.S. Provisional Application No. 60/944,368, filed Jun. 15, 2007, the entirety of which is hereby incorporated herein.

BACKGROUND OF THE INVENTION

1. Field of the Invention

This invention relates to the field of air purifiers, more specifically to air purifiers with lights.

2. Background of the Invention

Air purifiers are commonly used to remove air contaminants from areas such as household rooms. Different types of air purifiers have been used to remove such contaminants. Drawbacks to conventional air purifiers include inefficiencies in their attachments to articles for use. For instance, inefficiencies in their attachment to a room wall.

Consequently, there is a need for an improved air purifier. Further needs include improved air purifier methods for attachment.

BRIEF SUMMARY OF SOME OF THE PREFERRED EMBODIMENTS

These and other needs in the art are addressed in one embodiment by an illuminating air purifier that includes an air ionizer, a back plate, and a light.

The foregoing has outlined rather broadly the features and technical advantages of the present invention in order that the detailed description of the invention that follows may be better understood. Additional features and advantages of the invention will be described hereinafter that from the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
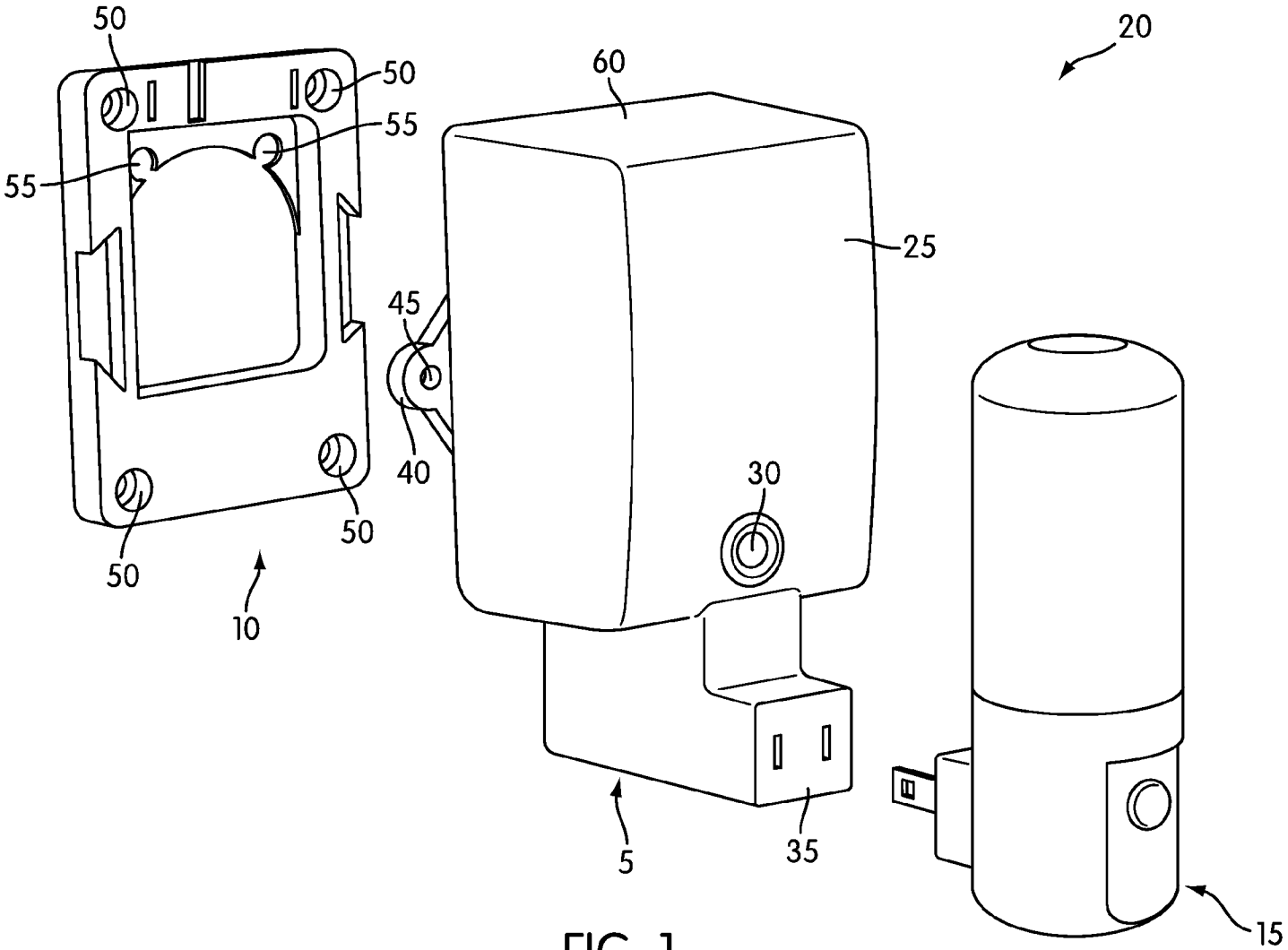
FIG. 1 illustrates an illuminating air purifier comprising an air filter with back plate and light unattached.

FIG. 1 illustrates illuminating air purifier 20 comprising air purifier 5, back plate 10, and light 15. Air purifier 5 may include any air purifier suitable for use in removing contaminants and/or odors from the air within and/or around any item (e.g., a wall, toilet, cage, and the like). Without limitation, examples of suitable air purifiers include mechanical filter devices, absorbent devices (e.g., devices that filter air through absorbents such charcoal), and air ionizers. Any air ionizer suitable for removing particulate and/or odors from the environment (e.g., air) may be used. An example of an air ionizer is an electrostatic precipitator. Electrostatic precipitators refer to a particulate collection device that removes particles from air using the force of an induced electrostatic charge. In some embodiments, produced ions exit the air ionizer and migrate through the air by ionic flow. Without limitation, examples of commercial electrostatic precipitators include the NATURAL AIR and HYBRID GP. The NATURAL AIR is an electrostatic precipitator commercially available horn Natural Air Systems, Inc. HYBRID GP is an electrostatic precipitator commercially available from THE SHARPER IMAGE. The air purifier may be disposed at any suitable location on the particular item by which the air purifier may remove particulate and/or reduce odor from the air within and/or around the item. For instance, one or more air purifiers may be attached to a wall. The air purifier may also include the air purifier and applications thereof disclosed in U.S. patent application Ser. No. 11/563,650, filed Nov. 27, 2006, which is incorporated by reference herein in its entirety.

In an embodiment, air purifier 5 includes housing 25, an entrance port (not illustrated), exit port 30, and electrical socket 35. In such an embodiment, air purifier 5 is an air ionizer. Air purifier 5 may also optionally include at least one wing surface 40. In some embodiments, air purifier 5 has two wing surfaces 40 with a wing surface 40 (not illustrated) on the opposite side of housing 25 from the wing surface 40 illustrated in FIG. 1. A fan (not illustrated) is disposed within housing 25. The fan may be powered by any suitable source such as by battery or from an available electric supply (e.g., from a wall socket). Air purifier 5 operates to draw air in through the entrance port into housing 25. Ions are produced and exit through exit port 30. In all embodiments, exit port 30 has a smaller diameter than the entrance port. Without being limited by theory, ions are produced from the air inside housing 25 by venturi effect and exit through exit port 30. In an embodiment in which air purifier 5 has at least one wing surface 40, wing surface 40 may be used to attach air purifier 5 to a surface. For instance, a nail or a screw may be inserted through wing opening 45 to secure air purifier 5 to the surface (e.g., a wall).

As shown in FIG. 1, light 15 may be inserted into electrical socket 35. Upon electrical flow through air purifier 5, electrical socket 35 may provide electricity to light 15, which may then emit light. Light 15 may include any suitable light such as a light emitting diode (LED).

In an embodiment, air purifier 5 further includes an electrical plug (not illustrated). The electrical plug may be inserted into an electrical socket (not illustrated) to provide electrical power to air purifier 5 and optionally to light 15.

In some embodiments, back plate 10 is secured to air purifier 5. Back plate 10 may be attached to a surface through attachment openings 50. For instance, nails or screws (not illustrated) may be inserted through attachment openings 50 to secure back plate 10 to the surface (e.g., a wall). In an embodiment, back plate 10 may also include hooks (not illustrated) that may be used to attach back plate 10 to an item such as a cage. In some embodiments of such embodiment, the hooks may be embedded in back plate 10 and may be released by spring action to allow back plate 10 to attach to the item. Air purifier 5 may be secured to back plate 10 by any suitable means. In an embodiment as shown in FIG. 1, attachment means (not illustrated) on back side 60 of air purifier 5 slide up and through back plate receiving means 55 to secure air purifier 5 to back plate 10. The attachment means may be any suitable means for attaching air purifier 5 such as suction I cups and the like.

Figure 2:
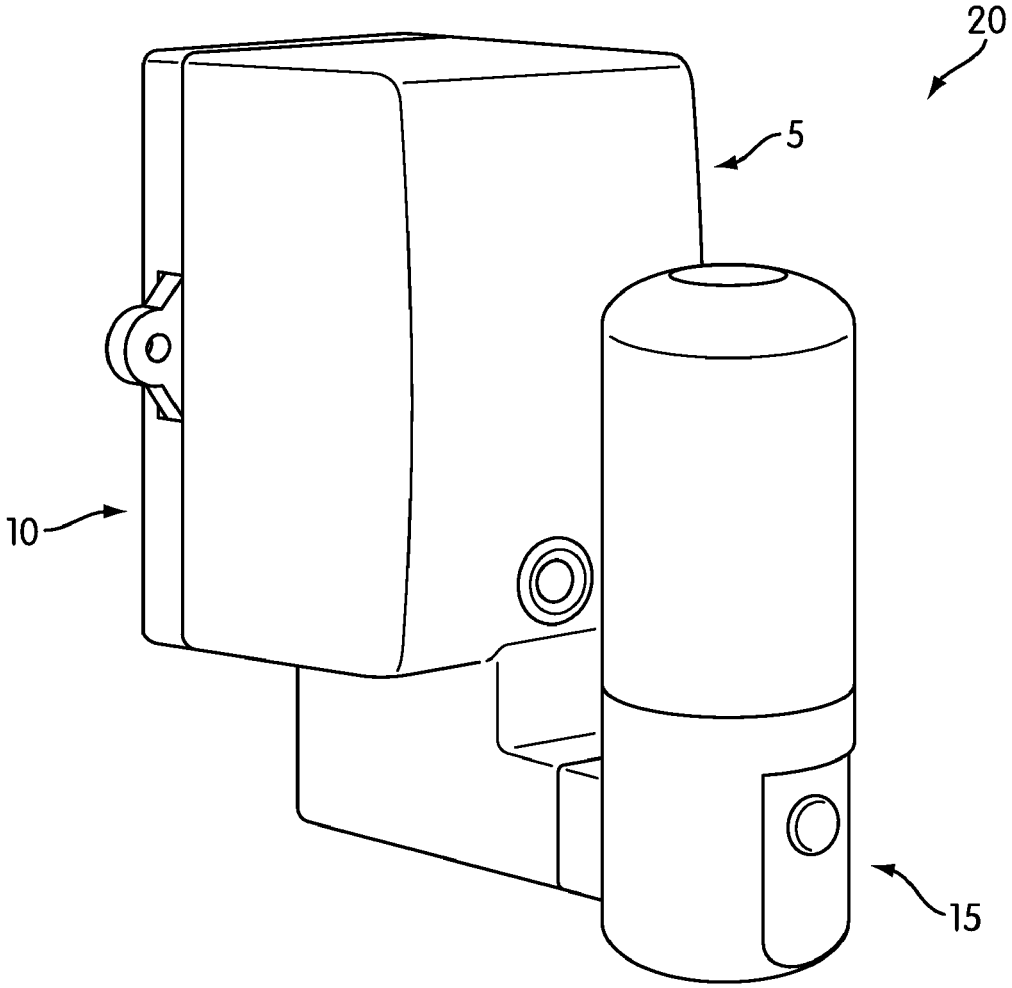
FIG. 2 illustrates the illuminating air purifier of FIG. 1 with the light and back plate attached to the air purifier.

As shown in FIG. 2, illuminating air purifier 20 includes back plate 10 secured to air purifier 5 with light 15 plugged into air purifier 5.

Although the present invention and its advantages have been described in detail, it should be understood that various changes, substitutions aid alterations may be made herein without departing from the spirit and scope of the invention as defined by the appended claims

What is claimed is:

1. An illuminating air purifier, comprising:

an air ionizer having a housing and an exterior electrical socket;

a back plate for attachment to the housing; and a light comprising a plug for plugging the light into the electrical socket.

2. The illuminating air purifier of claim 1 wherein the air ionizer comprises an electrostatic precipitator.

3. The illuminating air purifier of claim 1 wherein the housing comprises a wing surface.

4. The illuminating air purifier of claim 3 wherein the wing surface comprises an opening to secure the housing to a surface.

5. The illuminating air purifier of claim 1 wherein the back plate comprises openings for attachment to a surface.

6. The illuminating air purifier of claim 1 wherein the light comprises an LED.

7. The illuminating air purifier of claim 1 wherein the housing is releasably secured to the back plate.

8. The illuminating air purifier of claim 5 wherein the housing is releasably secured to the back plate.

9. The illuminating air purifier of claim 3 wherein the housing is releasably secured to the back plate.

10. The illuminating air purifier of claim 4 wherein the housing is releasably secured to the back plate.

* * * * *